US006766166B1

(12) United States Patent
Draim

(10) Patent No.: US 6,766,166 B1
(45) Date of Patent: Jul. 20, 2004

(54) ANTENNA NULL

(75) Inventor: John E. Draim, Vienna, VA (US)

(73) Assignee: Mobile Communications Holdings, Inc., Washington, DC (US)

( * ) Notice: Subject to any disclaimer, the term of this patent is extended or adjusted under 35 U.S.C. 154(b) by 818 days.

(21) Appl. No.: 09/160,634

(22) Filed: Sep. 23, 1998

(51) Int. Cl.[7] ..... H04H 1/00

(52) U.S. Cl. ..... 455/430

(58) Field of Search ..... 455/427, 428, 455/429, 430, 13.2, 13.4, 63, 3.2

(56) References Cited

U.S. PATENT DOCUMENTS

| | | | | | |
|---|---|---|---|---|---|
| 3,931,623 | A | * | 1/1976 | Sones | 343/225 |
| 5,491,833 | A | * | 2/1996 | Hamabe | 455/33.1 |
| 5,559,806 | A | * | 9/1996 | Kurby | 370/95.3 |
| 5,603,077 | A | * | 2/1997 | Muckle | 455/3.2 |
| 5,797,083 | A | * | 8/1998 | Anderson | 455/25 |
| 5,914,946 | A | * | 6/1999 | Avidor | 370/336 |
| 5,983,071 | A | * | 11/1999 | Gagnon | 455/3.2 |
| 6,075,969 | A | * | 6/2000 | Lusignan | 455/3.2 |

* cited by examiner

*Primary Examiner*—Nick Corsaro
(74) *Attorney, Agent, or Firm*—Fish & Richardson P.C.

(57) ABSTRACT

Antenna steering to put an interfering satellite in the null of the main antenna beam.

7 Claims, 6 Drawing Sheets

ANTENNA NULL

The present invention relates to compensation of communications when different satellite systems overlap with one another.

BACKGROUND

Satellite systems require communication between a base station on the ground, and a satellite in orbit. The base station on the ground needs to track the satellite in order to receive and transmit the information to the satellite.

As more and more satellites are used in low earth orbits, a possibility occurs that two satellites will interfere with one another.

Two satellites can interfere when both enter the main beam of the same base station. When the two satellites coalesce at the same point on the same frequency, they will interfere with one another, and could interrupt or degrade transmissions to one or both of the satellites.

SUMMARY

The normal expectation in the art and normal operation in practice is that the center line of a beam from a base station should point directly at the center line of the satellite. This would provide perfect tracking of the satellite. However, the inventor recognized that the satellite can still be tracked and communication can continue, so long as the tracking with one's own satellite is within a zone. That zone is defined by the characteristics of the antenna that is transmitting and receiving.

According to an embodiment, characteristics of the feeder antenna are determined. Typically, the spatial characteristics of the feeder antenna have a predetermined waveform which has nulls therein which define areas of lower antenna gain. According to this embodiment, the desired satellite is steered to a position in the beam which is offset from the center of the beam but which puts the undesired satellite as close to a null as possible. This is done by two dimensional steering of the beam away from the center point of the satellite, i.e., steering in azimuth and elevation.

BRIEF DESCRIPTION OF THE DRAWINGS

These and other aspects of the invention will now be described with reference to the attached drawings, in which.

DESCRIPTION OF THE PREFERRED EMBODIMENTS

Figure 1:
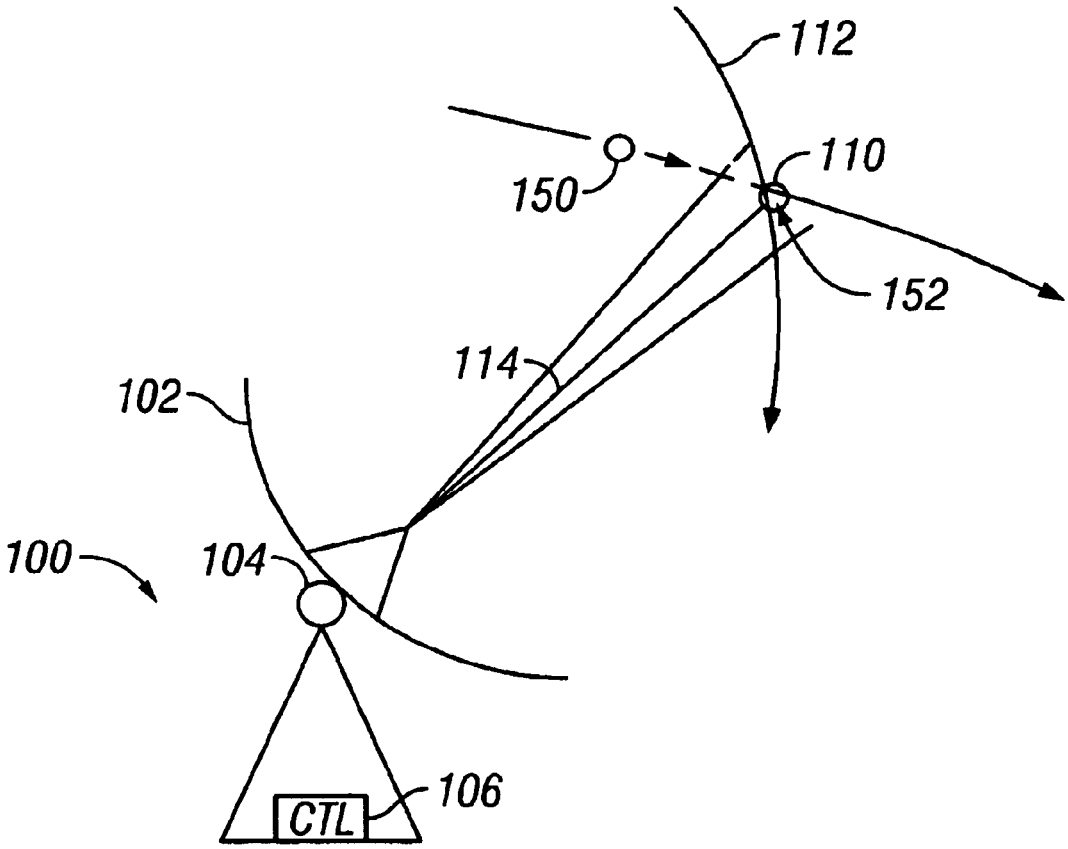
FIG. 1 shows a diagram of two satellites in orbit.

The basic problem is illustrated with reference to FIG. 1. The feeder link antenna 100 includes an antenna part 102 and a drive mechanism 104 driven by a controller 106 within the base station. The controller 106 runs a predetermined program that commands appropriate movement of the antenna 102, such that the antenna 102 automatically tracks the desired satellite 110 through its orbit 112. The center line 114 of the beam is normally aimed directly at the center line of desired satellite 110. In a non-geosynchronous satellite, the position of the satellite 110 is continually changing, and hence the position of the tracking antenna is being continuously recalculated.

FIG. 1 also shows a second satellite 150, which at time 152 will occupy more or less the same space as the first satellite 110. If the two satellites 110 and 150 operate on the same frequency, then they will interfere with one another at and near the position 152.

Figure 2:
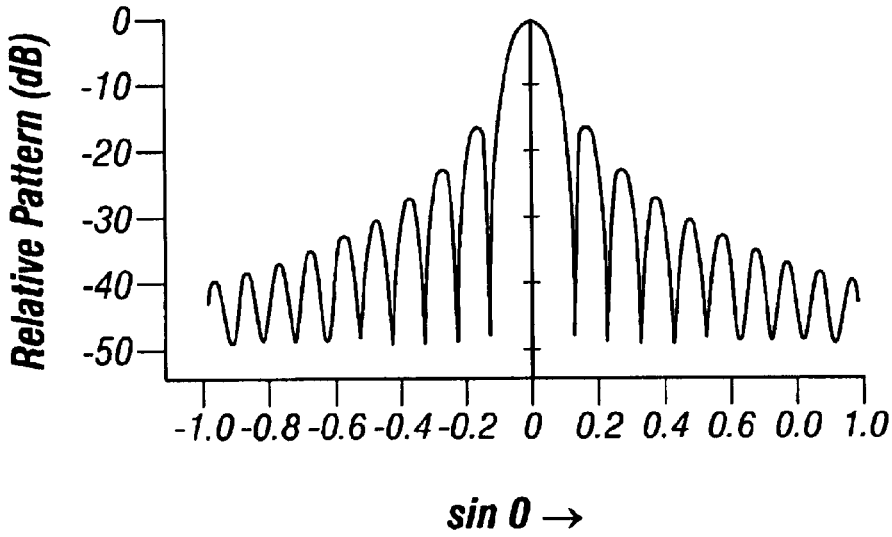
FIG. 2 shows a position vs gain diagram for a typical antenna.

The present inventor recognized, however, that antennas, and especially antennas of the feeder link type, do not have a flat transmission pattern. A circular aperture antenna typically has the transmission pattern with an envelope of the type shown in FIG. 2. This pattern has both maximums and minimums. The center beam (along the boresight axis) has the maximum gain and is referred to as the main lobe. Others on either side are referred to as side lobes. The minimums or nulls are directly between two adjacent maximums.

The operation according to this embodiment requires determining a priori information indicative of both the interfering satellite and one's own satellite's orbital path. This is normally known in advance since the orbital parameters and thus the paths of the satellites are known. This enables determining the angular direction and separation distance between the two satellites at all times. The controller in the ground station has an elevation azimuth computer that controls the antenna.

Then, the feeder link antenna is controlled to move the antenna to point at an area displaced from the center line of the satellite, but which places the interfering satellite more nearly into or near a null portion of the antenna. It also has the secondary effect of reducing the signal strength from the satellite to one's own satellite. However, since one's own satellite is nearer to the center line of the beam, it will not suffer as great a signal degradation as the degradation which will be created to the interfering satellite.

Figure 3:
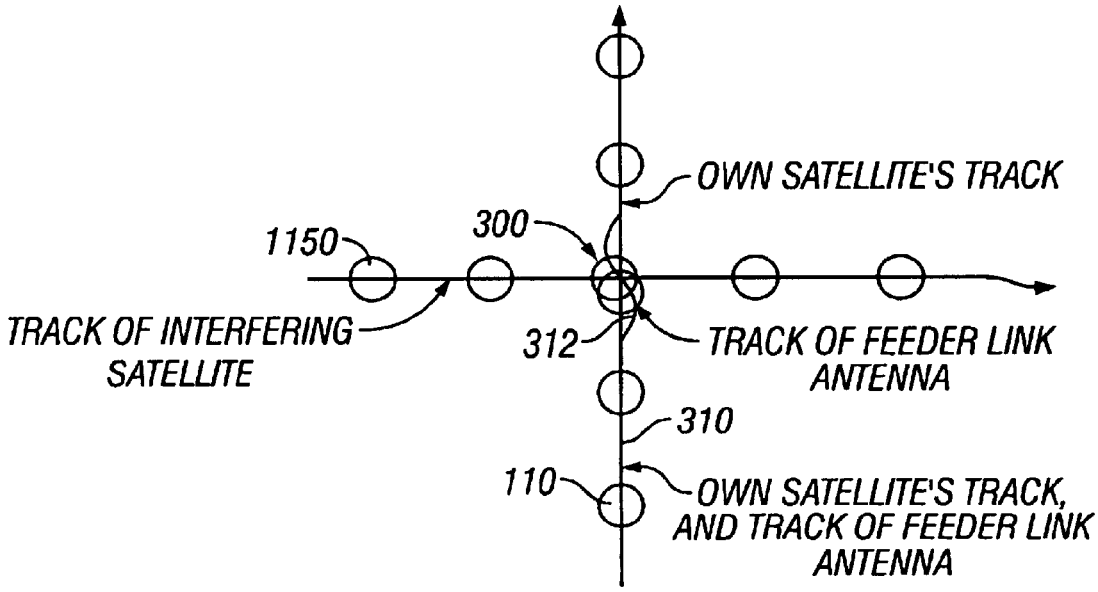
FIG. 3 shows tracks of the own satellite and the interfering satellite, and track of one's own ground antenna.

The operational system is shown in FIG. 3. FIG. 3 shows two satellites at different times, one's own satellite 110 and the interfering satellite 150. Both the own satellite 110 and the interfering satellite 150 have an orbit. At the time 300, the two satellites cross paths and would interfere.

The feeder link antenna follows the path shown by the line 310. During normal times, that is during times of non-interference between one's own satellite and the interfering satellite, the feeder link center follows the center line of the orbit of the satellite. However, when the two satellites come into interfering range with one another at point 310, the feeder link antenna pointing is varied, shown as 312, to take it off of the center line of one's own satellite. The variance off of the center line of one's own satellite moves the interfering satellite to a point where it is preferably in or near a null portion of the feeder antenna. Hence, while the signal to one's own satellite is slightly degraded, the signal to the interfering satellite is degraded even more. This requires relatively precise movement of the feeder beam; however, the maximum movement amount (angular velocity) of the feeder antenna only occurs at points very near the coincident point of the satellites.

Figure 3A:
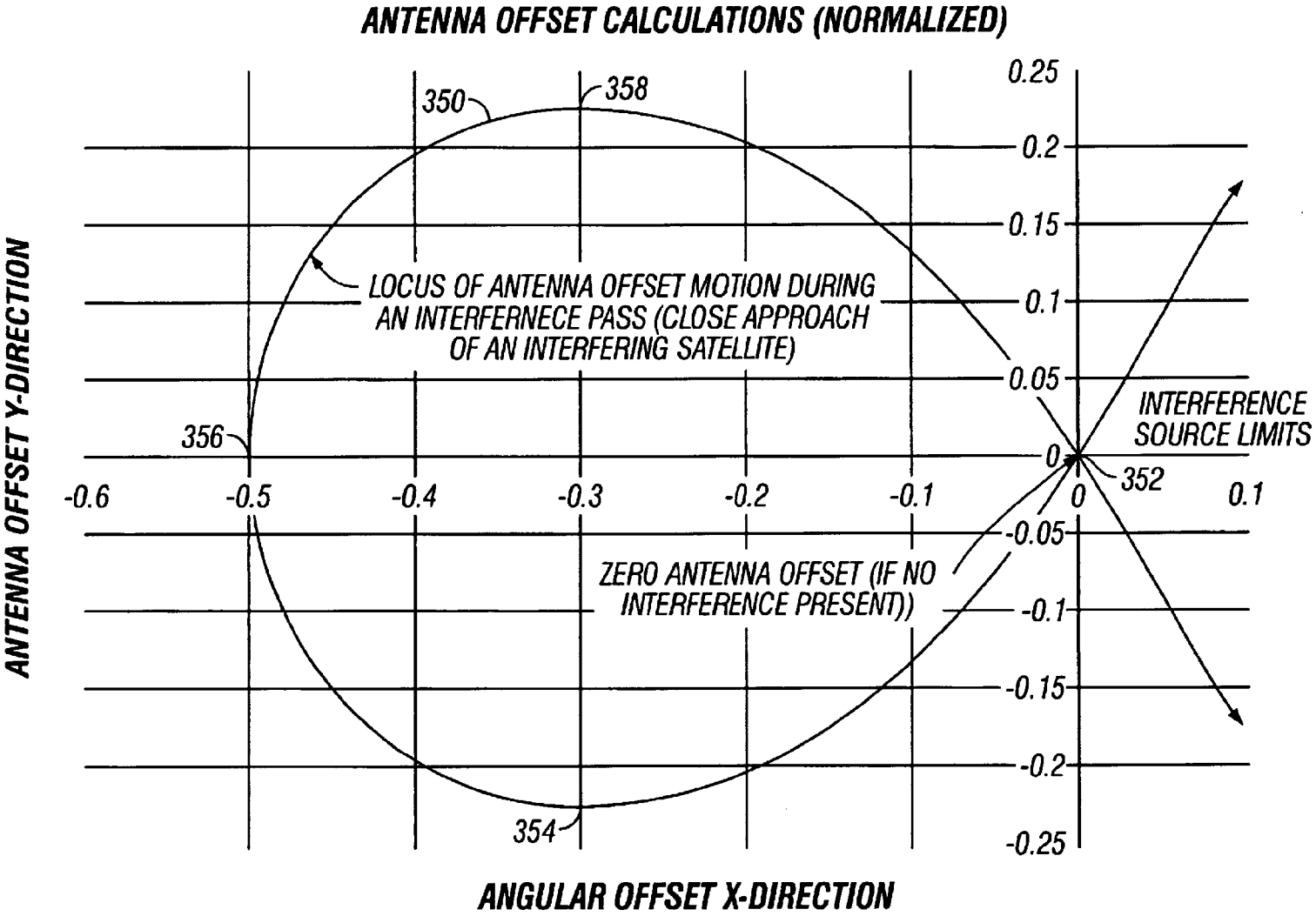
FIG. 3A shows a diagram of offset during a time when the two satellites come close to one another, the closed curve being the offset between one's own satellite and the antenna boresight.

FIG. 3A shows a normalized curve of the antenna offset calculations for a normal operation. FIG. 3A shows the x and y directions of the antenna offset, with the dimension of time being represented by the path along the curve 350. The origin point of the curve 352 could be considered as time zero or any time prior to interference being present. At this time, the antenna is preferably pointed directly at the center portion of the satellite. As interference begins, the antenna is first offset in the negative X direction and in the negative Y direction. This means that the antenna is slowed down, so that it actually falls behind the satellite tracking. That is, during the time from 352 to 354, the antenna slows down, and falls behind the satellite. During all this time, the antenna is also moving off the X axis of the satellite.

From time 354 to 356, the antenna continues moving off the Y axis of the satellite, but begins catching up with the satellite in the X direction.

From time 356 to 358, the antenna continues increasing speed in the X direction, and also begins catching up in the X direction. Finally, from 358 to 352, the antenna continues to move towards perfect tracking of the satellite.

Note that the antenna angular velocity is maximum between the period 354 and 358. As discussed above, if there is a momentary coincidence between the two satellites, there will be a coverage outage during that time. However, this system minimizes the amount of time during which the outage will occur.

The curve shown in FIG. 3A was found experimentally to represent the ideal curve for following the satellite. This curve is called the Nicomedes conchoid. The conchoid of Nicomedes can be described by the polar equation R=AC+K.

Note that the operation may, in addition, take advantage of a preset limit in the amount of offset. The limit can be manually set, and in FIG. 3A is represented by the limit radius edges of the curve.

Figure 4:
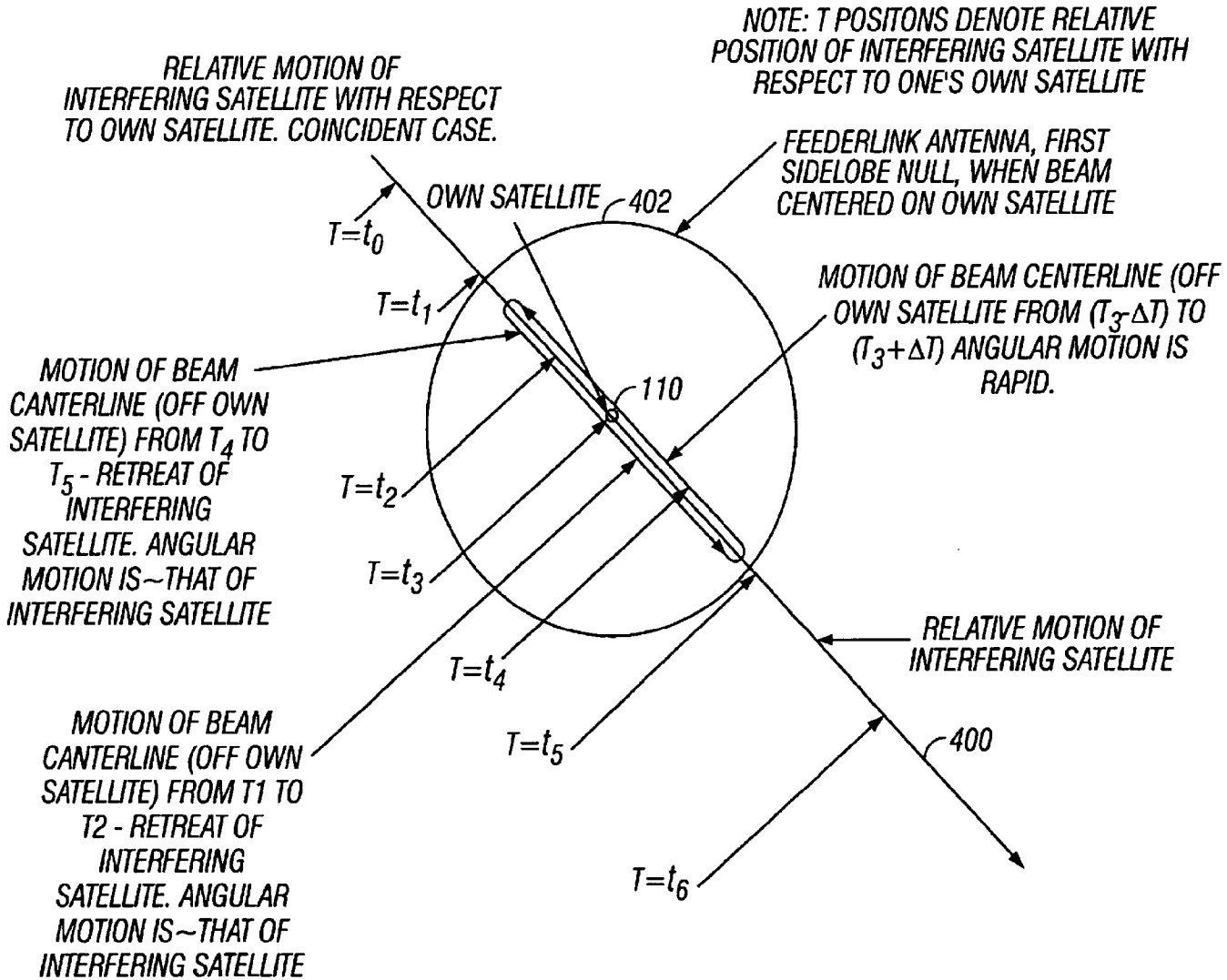
FIG. 4 shows a diagram of relative motion during a pass of satellites where there is coincidence.

The following descriptions shown operations for the different kinds of cases. The first case described with reference to FIG. 4, is when the tracks of the satellite will cross exactly. At the moment those two satellites cross, there is no way to avoid interference.

This technique takes advantage of that. According to this system, at first the satellite is speeded up or slowed down a little, to place the interfering satellite on the other side of one's own satellite. A limit of offset is established, which defines the maximum amount of speed-up or slow-down. This takes the satellites out of alignment, and preferably places the interfering track of the interfering satellite in the antenna null of the own satellite. In this say, the length of time the interference occurs can be minimized. According to the system used by the assignees of the present invention, the "Ellipso" system, so long as the interference time is maintained at less than 10 seconds, the satellite telephone call will be kept and reconstituted at the end of the 10 seconds.

FIG. 4 shows a number of different time periods. If $T=T_0$, there is no interference between the two satellites.

At a position $T=T_1$, the own satellite 110 comes to a position where it begins to interfere with the other satellite 150. The period between $T_1$ and $T_2$ represents the approach of the interfering satellite. The angular motion of the antenna is approximately that of the interfering satellite. This takes the own satellite slightly off its axis to minimize the amount of interference.

From $T_3-\Delta T$ to $T_3+\Delta T$, the angular motion of the own satellite is rapid. From $T_4$ to $T_5$, the angular motion is approximately that of the interfering satellite.

Figure 5:
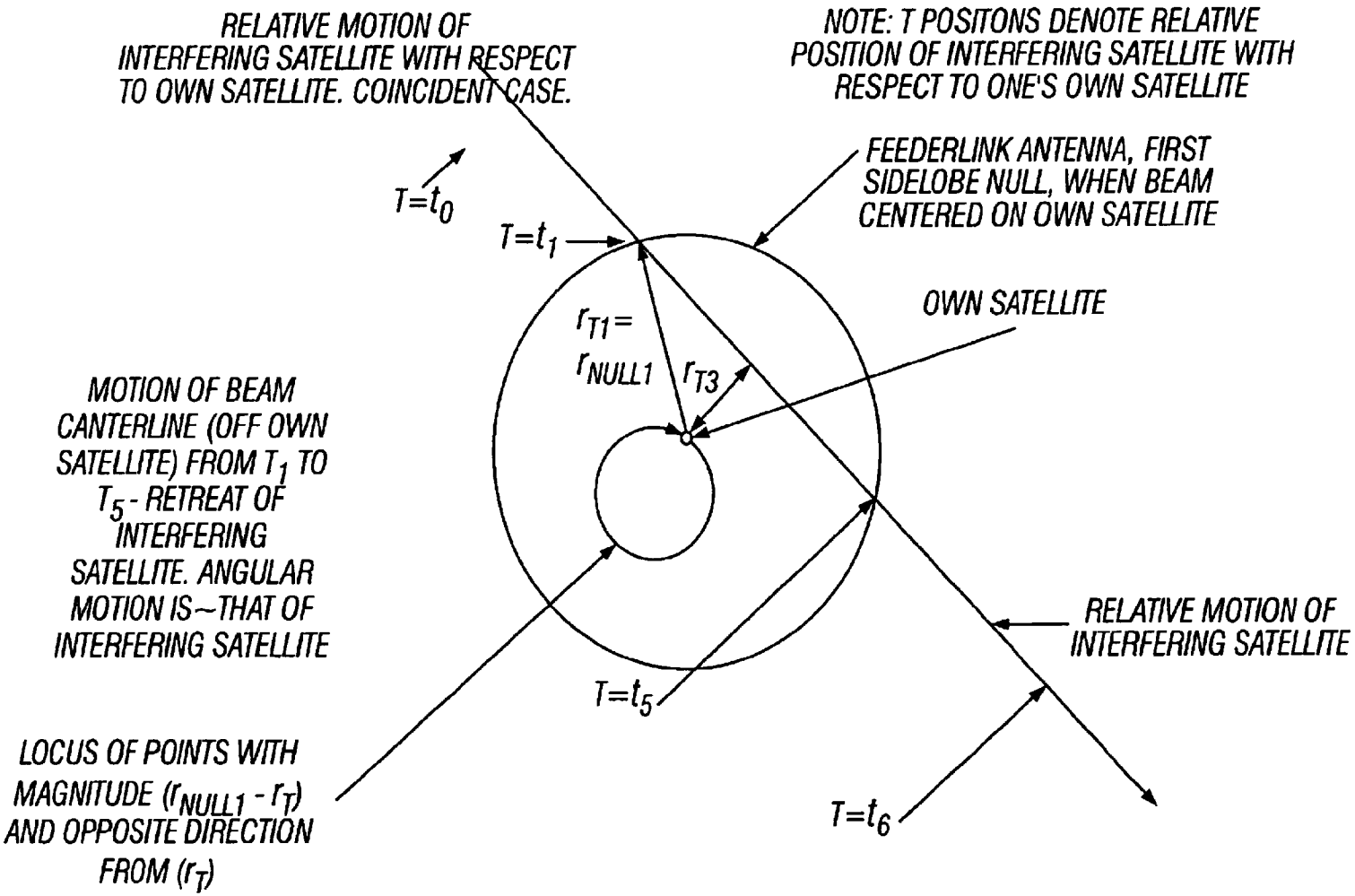
FIG. 5 shows a diagram of relative motion during a pass of satellites where there is a moderately close approach.

FIG. 5 shows the case for relative motion between the two satellites and approach a moderately close approach case. According to FIG. 2B, the motion of the beam's center line from $T_1$ to $T_5$ minimizes the crossing of the two satellites. A Locus of Points with Magnitude of $(r_{null1}-r_T)$ and opposite direction from $(R_T)$ is applied to the own satellite. These T positions denote the relative position of the interfering satellite with respect to one's own satellite.

Figure 6:
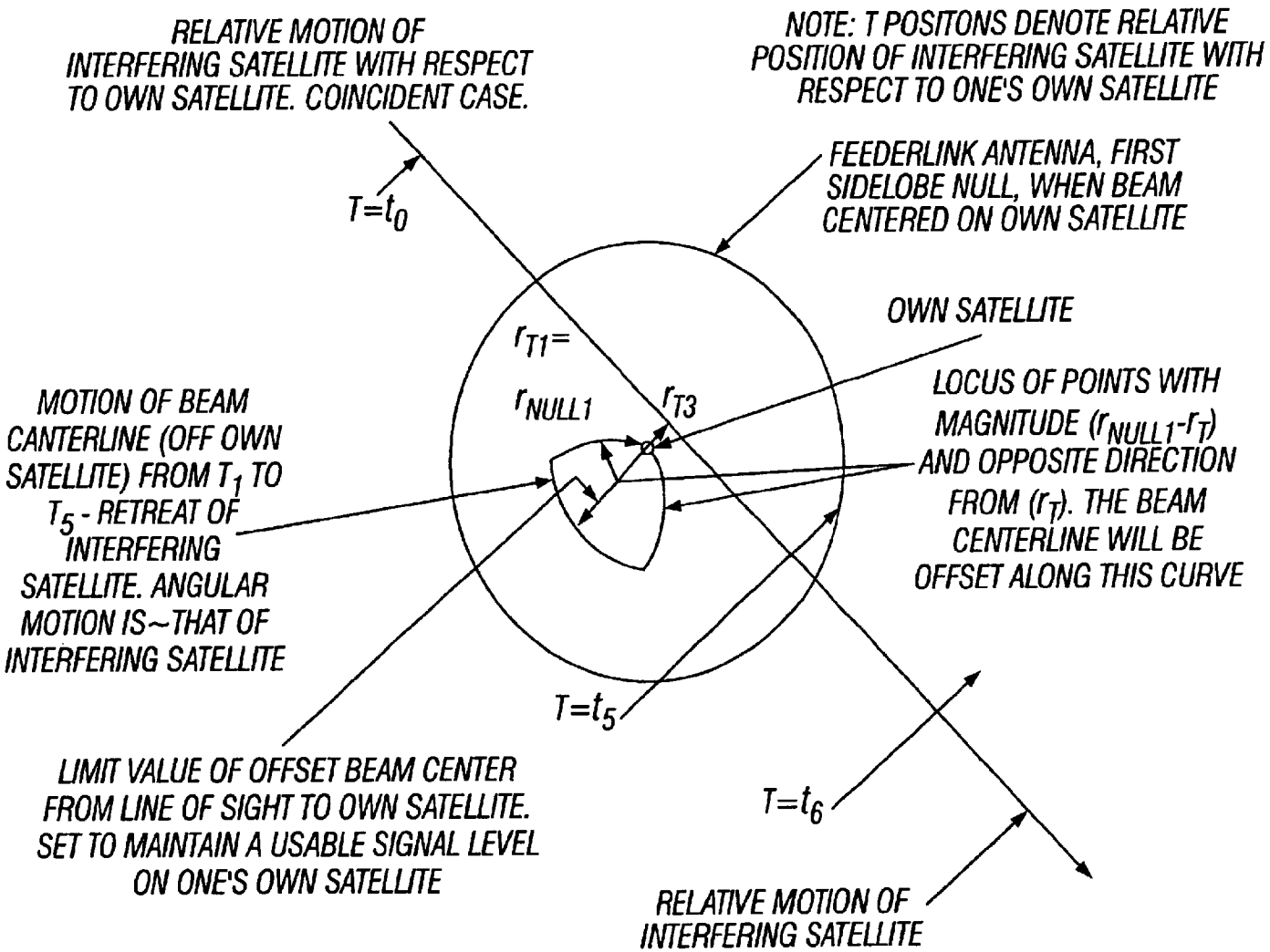
FIG. 6 shows a diagram of relative motion during a pass of satellites where there is a very close approach.

FIG. 6 shows the very close approach case. In this case, the beam's center line is offset along the curve. As discussed above, in the event of very close conjugation, the interference has to occur during a short period of time. However, the period of time during which the interference actually occurs is minimized, and the amount of offset of one's own satellite is limited by the amount of gain loss that can be tolerated in any event even when the approach of the interfering satellite is very close. The two pieces closest to center are parts of the conchoid. The single portion of the curve described as the limit valve is a constant radius from the satellite position. It represents an amount of signal level you don't want to go below—even if there is some bothersome amount of interference from the other, interfering satellite.

In general, when the intent is programmed to accept a loss of signal and still maintain track for some time interval, typically 10 seconds.

Although only a few embodiments have been described in detail above, other embodiments are contemplated by the inventor and are intended to be encompassed within the following claims. In addition, other modifications are contemplated and are also intended to be covered.

What is claimed is:

1. A satellite communication system, comprising:

a ground station, having a main antenna which is movable, said main antenna of a type which produces a central beam and side lobe beam with null portions between at least two of said beams, said ground station also including a controller which can determine interference between a satellite being monitored and another satellite, wherein said controller also controls a pointing position of the main antenna, and said controller is operative to normally point a center of the antenna directly at said satellite being monitored, and responsive to determining a likelihood of interference, moves a center line of the antenna away from the satellite being monitored, and toward said null portion.

2. A system as in claim 1 wherein the movement is such that an amount of decrease to the interfering satellite is more than an amount of decrease to the monitored satellite.

3. A system as in claim 2 wherein the antenna is moved during one part of the interfering path of the satellite to proceed the monitored satellite, and during another part of the interfering path of the satellite to trail the monitoring satellite.

4. A system as in claim 2 wherein the ground station includes an azimuth/elevation drive computer and also includes information indicating positions and velocities of the monitored satellite and at least one interfering satellite.

5. A system as in claim 1, wherein said main antenna is steered directly at said null portion during a time of likelihood of interference.

6. A system as in claim 2, wherein said antenna is moved over time with a shape over time which follows a shape defined by the conchoid of Nicomedes.

7. A method of tracking a satellite, comprising:

using a ground station which has a main antenna producing a main lobe beam and side lobe beams, and null portions between the main lobe beam and side lobe beams to monitor a satellite;

determining a likelihood of interference between said satellite and another satellite; and moving said antenna so that a beam of said antenna has a null portion directed to said interfering satellite during a time of said interference.

* * * * *